United States Patent [19]

Kikuma et al.

[11] Patent Number: 4,700,312

[45] Date of Patent: Oct. 13, 1987

[54] METHOD AND APPARATUS FOR CONTROLLING SNAKE MOTION IN ROLLING MILLS

[75] Inventors: Toshio Kikuma, Fukuoka; Hiromi Matsumoto, Kitakyushu; Masayoshi Tagawa, Ibaraki; Toshiyuki Kajiwara, Hitachi; Tomoaki Kimura, Hitachi; Yoshihiko Iida, Hitachi; Kenichi Yoshimoto, Hitachi, all of Japan

[73] Assignees: Hitachi, Ltd.; Nippon Steel Corporation, both of Tokyo, Japan

[21] Appl. No.: 633,574

[22] Filed: Jul. 23, 1984

Related U.S. Application Data

[63] Continuation of Ser. No. 107,630, Dec. 27, 1979, abandoned.

[30] Foreign Application Priority Data

Dec. 27, 1978 [JP] Japan ..... 53-159901

[51] Int. Cl.[4] ..... G06F 15/46; G05B 11/42; B21B 37/12

[52] U.S. Cl. ..... 364/472; 72/8; 364/160; 364/163

[58] Field of Search ..... 364/160-163, 364/157, 472, 468, 469; 72/8-12, 127

[56] References Cited

U.S. PATENT DOCUMENTS

| | | | |
|---|---|---|---|
| 3,404,550 | 10/1968 | Plaisted | 72/8 |
| 3,491,562 | 1/1970 | Kajiwara | 72/12 |
| 3,573,444 | 4/1971 | Kawabata | 364/472 X |
| 3,587,263 | 6/1971 | McCarthy | 72/8 |
| 3,613,419 | 10/1971 | Silva | 72/8 |
| 4,025,763 | 5/1977 | Kleiss | 364/160 X |
| 4,149,395 | 4/1979 | Fapiano | 72/11 |

OTHER PUBLICATIONS

Thaler et al.—"Servomechanism Analysis"—McGraw-Hill Book Co., Inc.—1953—pp. 88-105.

*Primary Examiner*—Joseph F. Ruggiero
*Attorney, Agent, or Firm*—Antonelli, Terry & Wands

[57] ABSTRACT

A method and an apparatus for controlling a rolling mill which dampens a snake motion of a material being rolled is disclosed. According to this method and apparatus, an amount corresponding to the snake motion of the material being rolled is detected, and the value thus detected is added to a value corresponding to a differentiated value of said detected value. A control operation is applied to the material being rolled to thereby control the snake motion of the material.

18 Claims, 26 Drawing Figures

METHOD AND APPARATUS FOR CONTROLLING SNAKE MOTION IN ROLLING MILLS

This is a continuation of application Ser. No. 107,630, filed Dec. 27, 1979, now abandoned.

BACKGROUND OF THE INVENTION

The present invention relates to a method and an apparatus for controlling rolling mills, and, more particularly to a method and an apparatus for controlling rolling mills suitable for preventing the zigzagging or snake motion of a material to be rolled.

The reduction ratio for operation and driving sides, or right and left sides, of the material being rolled in the rolling mill often develops an error due to the difference in hardness between the right and left sides of the material or the difference in roll gap between the value at the right and left sides of the material, with the result that the biting position of the material into the roll nip is displaced in the transversal direction of the material and the material to be rolled is curved in its longitudinal direction in what is called the snake or zigzagging phenomenon.

In the event that this nake or zigzagging phenomenon is considerable, the material being rolled is greatly displaced to one side, thereby leading to an excessive partial reduction of the material. This phenomenon may seriously damage or break the reduction rolls or input guide, often causing a great amount of material loss and/or time loss. Even in the case where the snake or zigzagging motion is not considerable, it is necessary to cut the ends of the curved portion of the material in the next step of operation to attain the same material width, thus reducing the product yield.

DESCRIPTION OF THE PRIOR ART

For better understanding of the present invention, it seems necessary to theoretically analyze the disadvantages of the conventional systems for snake motion control before description of the present invention.

In the conventional control systems, in order to prevent the snake motion of the material being rolled, the amount of positional displacement or deviation in the transversal direction of the material or the amount of curvature thereof or other rolling conditions of the material is directly or indirectly detected by some means or other, so that in response to this detection signal, the difference between right and left roll gaps is automatically regulated.

In the conventional methods mentioned above, stable control is not obtained regardless of the control gain, i.e., the sensitivity for determining the change in difference between right and left roll gaps for each unit of the detected signal. In other words, in the case of a small control gain, the control amount is insufficient with respect to the amount of external factors causing the snake motion of the material being rolled, so that an excessively reduced condition occurs in spite of the controlling of the material being rolled. In the case where the control gain is increased, on the other hand, an oscillation with an increased amplitude with time occurs so that the material being rolled is curved in its longitudinal direction in the form of repeated S's, thereby finally resulting in an excessively reduced condition. As seen from the foregoing description, the prior art system is accompanied by divergent control characteristics, whether simple or oscillatory. For this reason, irrespective of the control gain value determined, it is impossible to attain stable convergent characteristics, with the result that the control operation which must limit the snake motion has an adverse effect.

According to a prior art control system, in general, a detection signal is used to control the difference between right and left roll gaps, and the result of this control is produced as another detection signal which is in turn used in a feedback control loop to control the difference between right and left roll gaps. In this prior art system, in spite of the seemingly evident fact that satisfactory control may be effected by the feedback control loop, the requirements of feedback control actually fail to be met and the feedback control is not substantially established.

A conventional system for controlling rolling mills will be explained in detail below mainly with reference to FIGS. 1 to 5A.

Figure 1:
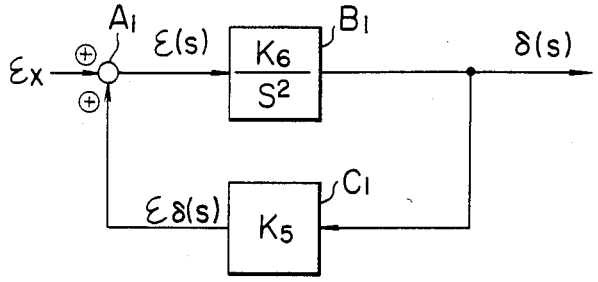
FIG. 1 is a block diagram showing in equivalent form the snake or zigzagging phenomenon or motion of a material to be rolled.

In FIG. 1, the transfer function of the positional displacement $\delta(s)$ of the material being rolled as related to the difference $\epsilon x$ which is the difference in reduction ratio between right and left sides of the material which is caused by the reduction leveling error, the wedge of thickness of the plate material at the input side, the difference in hardness between the right and left sides, etc. and may be referred to as "disturbance reduction ratio difference" is given as $$\delta(s) = \frac{K_6}{s^2 - K_5 \cdot K_6} \quad (1)$$

where $K_5$ and $K_6$ are change factors.

The change with time in positional displacement $\delta$ of the material being rolled in the case of stepwise change in $\epsilon x$ is expressed by the equation (2) shown below by reverse Laplace transformation of equation (1).

$$\delta(t) = \frac{1}{2K_5}\left(e^{-\sqrt{K_5 \cdot K_6 \cdot t}} + e^{+\sqrt{K_5 \cdot K_6 \cdot t}} - 2\right) \quad (2)$$

Figure 2:
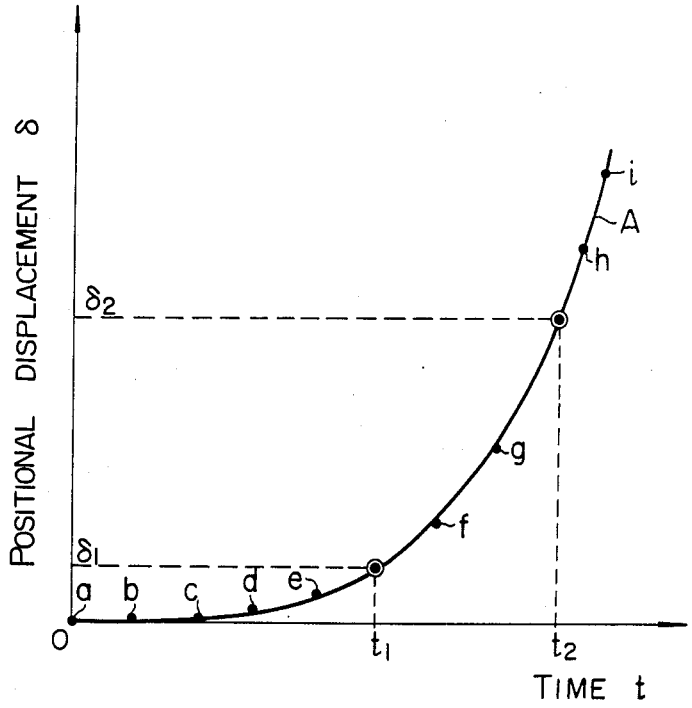
FIG. 2 is a graph showing the change in positional displacement with time in the block diagram of FIG. 1.

The curve A in FIG. 2 represents measurements of change in positional displacement $\delta$ of the material with the time t that has elapsed from the time point when the rolls begin to bite the material. On the basis of the two actual measurements of the positional displacement $\delta_1$ and $\delta_2$ of the material at the time points $t_1$ and $t_2$, the values $K_5$ and $K_6$ are determined from the equation (2). The values $K_5$ and $K_6$ thus determined, in turn, are used to determine the positional displacement of the material at respective time points. The result of calculation by the equation (2) substantially coincides with actual measurements. The measurements shown in FIG. 2 represent accurately the positional displacements of the material at the point of reduction and are determined in such a manner that a multiplicity of punched marks are attached to the central circumference along the width of the rolls and are printed on the material.

In order to effect the control for preventing the snake motion from occurring, i.e., snake motion control, the rolling conditions of the material being rolled are detected and in response to the resulting detection signals, the right and left conditions are regulated. More specifically, the difference $\Delta c(t)$ between right and left reduction ratios which is caused by the reduction operations at the right and left sides by mans of the snake motion control acts on the material thereby to control the difference between the right and left reduction ratios $\epsilon(t) = (\epsilon x + \epsilon\delta(t) - \epsilon c(t))$ where $\epsilon\delta(t)$ is the difference in reduction ratio between the right and left sides which is caused by the snake motion of the material being rolled and where $\epsilon(t)$ is the difference in reduction ratio between the right and left sides which actually appears in the material being rolled as the sum of "$\epsilon x$" and "$\epsilon\delta(t) - \epsilon c(t)$". In this way, this difference between right and left reduction ratios, which is the basic cause of positional displacement or curvature of the material being rolled, is finally substantially eliminated.

Actual representative examples used in the prior art for the snake motion control mentioned above are shown in FIGS. 3A, 3B and 3C.

Figure 3A:
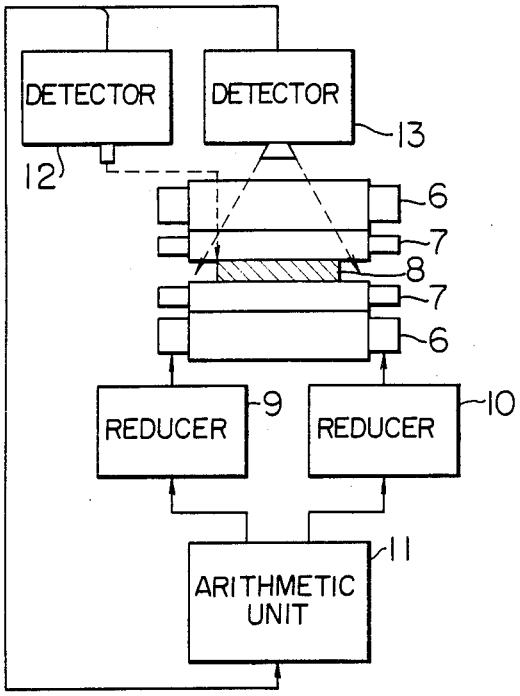
FIG. 3A PRIOR ART
FIGS. 3A, 3B and 3C are schematic diagrams for briefly explaining three examples of the snake motion control in the prior art.

In the case of FIG. 3A, the positional displacement of a material 8 is detected by a detector 12 or the change in the rolling condition caused by the positional displacement, curvature, or snake motion of the material 8 is detected by a detector 13 such as a television camera and the resulting detection signal is fed back to a control arithmetic unit 11. In response to the detection signal, the control arithmetic unit 11 controls the amount of difference between right and left reduction rates and the direction of reduction applied to the material 8 through reduction devices 9 and 10, a backup roll 6 and a work roll 7, thus regulating the snake motion. Japanese Utility Model Publication No. 24588/74 (published July 2, 1974) is referred to to show an example of this kind of prior art snake motion control.

Figure 3B:
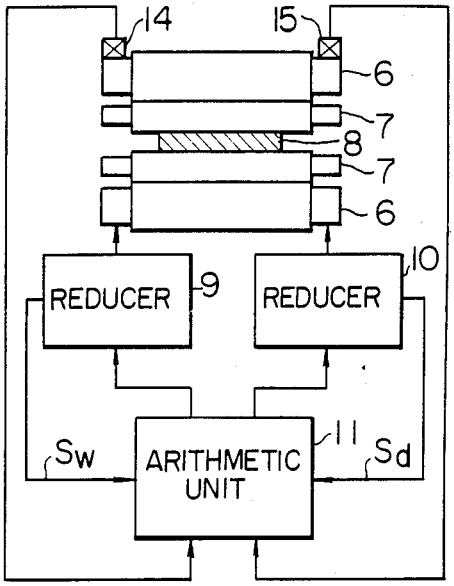
FIG. 3B PRIOR ART

In the system of FIG. 3B, rolling load detection signals from roling load meters 14 and 15 and roll gap detection signals $S_w$ and $S_d$ corresponding to values thereof under no-load condition at right and left sides produced from reduction devices 9 and 10 are used to detect the difference between right and left rolling loads and the difference between the right and left roll gaps corresponding to values thereof under no-load condition. In this way, the apparent difference between right and left thickness of the material 8 is detected, so that the snake motion is prevented from occurring by reducing the apparent difference between right and left thicknesses of material to zero. Japanese Patent Laid-Open No. 124453/77 (laid open Oct. 19, 1977) is referred to to show an example of this kind of prior art snake motion control.

Figure 3C:
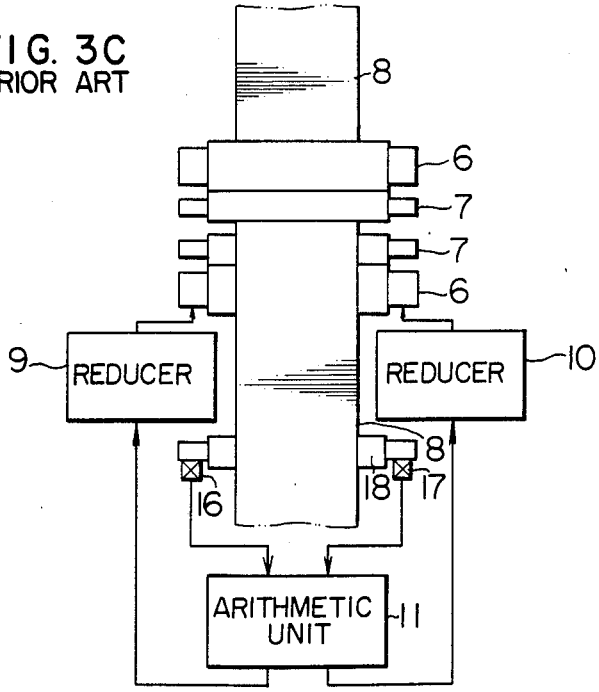
FIG. 3C PRIOR ART

In the case of FIG. 3C, on the other hand, load meters 16 and 17 detect the right and left bearing loads of the roller 18 arranged to receive the tension of a material 8. In response to the detection signals produced from the load meters 16 and 17, the change in rolling condition caused by the positional displacement or snake motion of the material 8 is detected, thus controlling the snake motion thereof. Japanese Utility Model Laid-Open No. 68428/77 (laid open May 20, 1977) is referred to to show an example of this kind of prior art snake motion control.

A number of systems other than those described with reference to FIGS. 3A to 3C may be used for snake motion control. Regardless of which system is used, however, the prior art snake motion control may be, in general, configured of three basic elements of blocks a, b and c as shown in FIG. 4A.

Figure 4A:
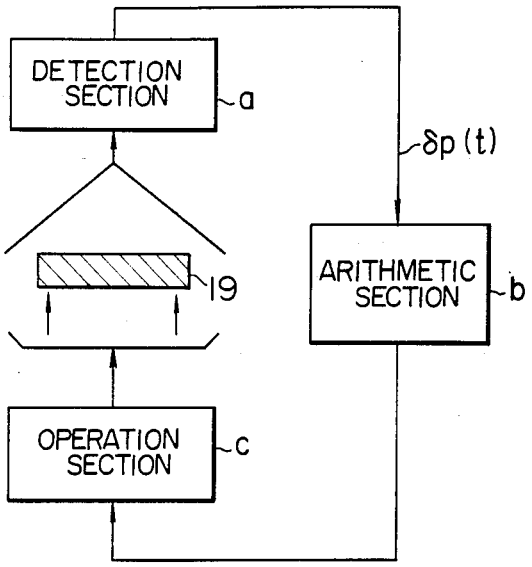
FIG. 4A PRIOR ART
FIG. 4A is a schematic block diagram generally showing the snake motion control in the prior art.

In FIG. 4A, a block a shows a detection section for producing a detection signal $\delta p(t)$ in accordance with the snake motion found from the rolling condition of a material 19. This detection section block a corresponds to the position detector 12 and the detector 13 in FIG. 3A, the rolling load meters 14 and 15 in FIG. 3B or the load meters 16 and 17 in FIG. 3C. A block b is a control arithmetic section for producing a control signal by determining the amount and direction of control to be applied to the material 19 in response to the detection signal $\delta p(t)$ produced from the detection section block a. This control arithmetic section corresponds to the control arithmetic unit 11 shown in FIGS. 3A, 3B and 3C. A block c represents an operating section for controlling the material 19 in response to the control signal produced from the control arithmetic section block b. This operating section corresponds to the reduction devices 9 and 10, the backup roll 6 and the work roll 7 in FIGS. 3A, 3B and 3C.

Figure 4B:
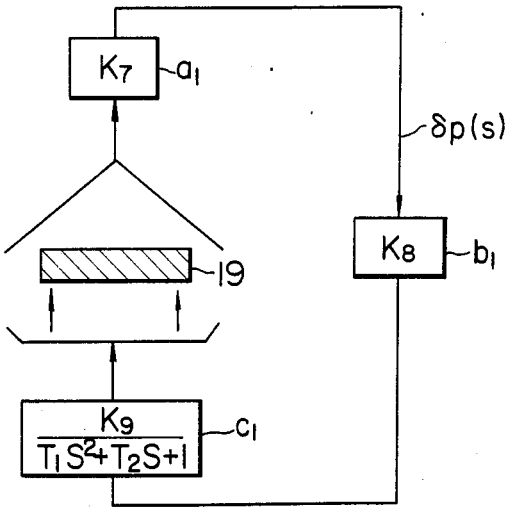
FIG. 4B PRIOR ART
FIG. 4B is a control block diagram similar to FIG. 4A.

FIG. 4B shows the system of FIG. 4A in the form of a control block. The reference character $K_7$ in a block $a_1$ shows the transfer function for the detection section a, the character $K_8$ in a block $b_1$ shows the transfer function for the control arithmetic section b, and the value $$\frac{K_9}{T_1 \cdot s^2 + T_2 \cdot s + 1}$$

in a block $c_1$ shows the transfer function for the operating section c.

Figure 5:
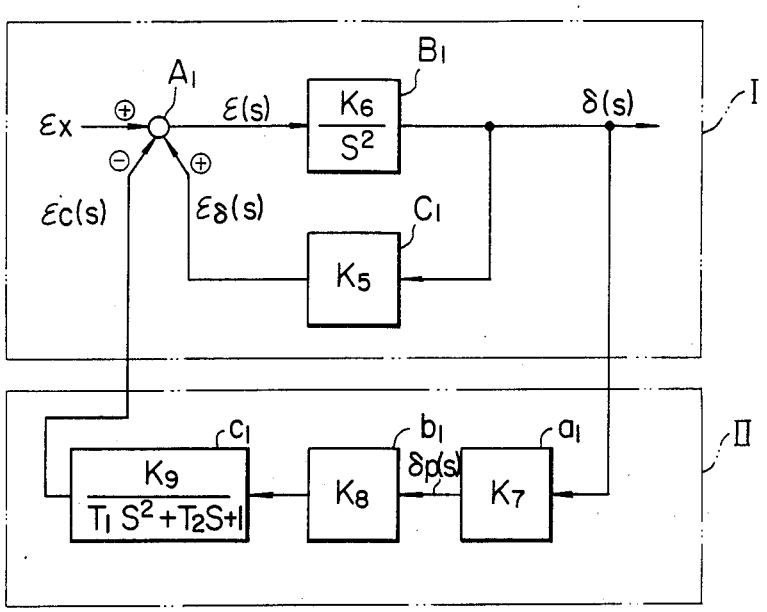
FIG. 5 PRIOR ART
FIG. 5 is a block diagram showing a control system in which the snake motion control shown in FIG. 4B is employed in the control loop of FIG. 1.

FIG. 5 is a control block diagram generally illustrating a conventional snake motion control system in which the block diagram of FIG. 1 equivalently representing the snake motion of the material 19 is incorporated in the control block diagram of FIG. 4B.

In FIG. 5, a block I defined by a two-dotted-chain line shows the snake motion of the material, and a block II defined by a two-dotted-chain line represents the control section for controlling the snake motion. The detection signal $\delta p(s)$ of the detection section $a_1$ is not limited to the detection signal for the positional displacement $\delta(s)$ of the material, but may alternatively take the form of the rolling load signals produced from the rolling load meters 14 and 15 shown in FIG. 3B, the load detection signals produced from the load meters 16 and 17 shown in FIG. 3C, the detection signal produced from the detector 13 shown in FIG. 3A or any other signal representing the amount of snake motion, i.e., a detection signal equivalently representing the positional displacement of the material directly or indirectly.

A control block diagram including the control system for snake motion according to the prior art is shown in FIG. 5. In this prior art snake motion control system shown in FIG. 5, the basic requirements of feedback control are not satisfied, thus substantially failing to establish the feedback control as will be explained below. Specifically, the control characteristics of the conventional systems are absolutely divergent and are basically incapable of control unless any other appropriate means are added thereto.

One of the methods for determining the stability of the feedback control system (i.e., determining whether the control characteristics are convergent or divergent) is by determining a characteristics equation of the control system and determining whether or not all the roots of the characteristics equation have negative real numbers by use of "Hurwitz stability criterion". According to this method, the characteristics of the control system in which all of the roots of the characteristics equation have no negative real numbers are considered to be always divergent and never function as a control.

The loop transfer function G(s) for control in the prior art method shown in FIG. 5 is given as $$G(s) = \frac{K \cdot K_6}{(s^2 - K_5 \cdot K_6)(T_1 \cdot s^2 + T_2 \cdot s + 1)} \quad (3)$$

where K is a control gain capable of being changed arbitrarily as desired and expressed as $K_7 \cdot K_8 \cdot K_9$. The characteristics equation is given as $G(s)+1=0$, the detail of which is given as the equation (4) shown below. In other words, the characteristics equation for the conventional systems is expressed as $$T_1 \cdot s^4 + T_2 \cdot s^3 + (1 - K_5 \cdot K_6 \cdot T_1)s^2 - K_5 \cdot K_6 \cdot T_2 \cdot s + K_6(K - K_5) = 0 \quad (4)$$

If all the roots in the characteristics equation of (4) have negative real numbers, the control is convergent and stable. Whether or not all the roots of this characteristics equation have a negative real number is easily determined by the "Hurwitz criterion". The inequalities (5) to (9) shown below represent necessary and sufficient conditions for all the roots of the characteristics equation (4) determined from the Hurwitz criterion to have a real number.

$$T_1 > 0, \quad (5)$$

$$T_2 > 0, \quad (6)$$

$$1 - K_5 \cdot K_6 \cdot T_1 > 0, \quad (7)$$

$$-K_5 \cdot K_6 \cdot T_2 > 0, \quad (8)$$

$$K_6(K - K_5) > 0, \quad (9)$$

$$-K_5 \cdot K_6 \cdot T_2^2 > 0, \quad (10)$$

where $T_1$, $T_2$, $K_5$, $K_6$ and K are all positive real numbers, in which $T_1$ and $T_2$ are time constants showing the transfer lag of the operating section $C_1$ in FIG. 5 and have always a certain value which is never reduced to zero. Also, $K_5$ and $K_6$ are proportionality factors related to the snake motion which are values to be determined dependently on the rolling or other conditions. The magnitude of each of the values $K_5$ and $K_6$ cannot be changed arbitrarily. For the reason mentioned above, the terms $-K_5 \cdot K_6 \cdot T_2$ and $-K_5 \cdot K_6 \cdot T_2^2$ on the left side of the inequalities (8) and (10) are always negative, and therefore it is absolutely impossible to satisfy the necessary condition $-K_5 \cdot K_6 \cdot T_2 > 0$ and $-K_5 \cdot K_6 \cdot T_2^2 > 0$. This means that all the roots of the characteristics equation (4) are incapable of having a negative real number and hence that the control in the above-mentioned prior art system can never attain a convergent stability but always is divergent unless some other effective means is taken. The method for determining whether the control system is converged to stability or divergent by the above-mentioned characteristics equation for the control system and the Hurwitz criterion is commonly used in the field of automatic control and therefore will not be explained in detail.

Figure 6A:
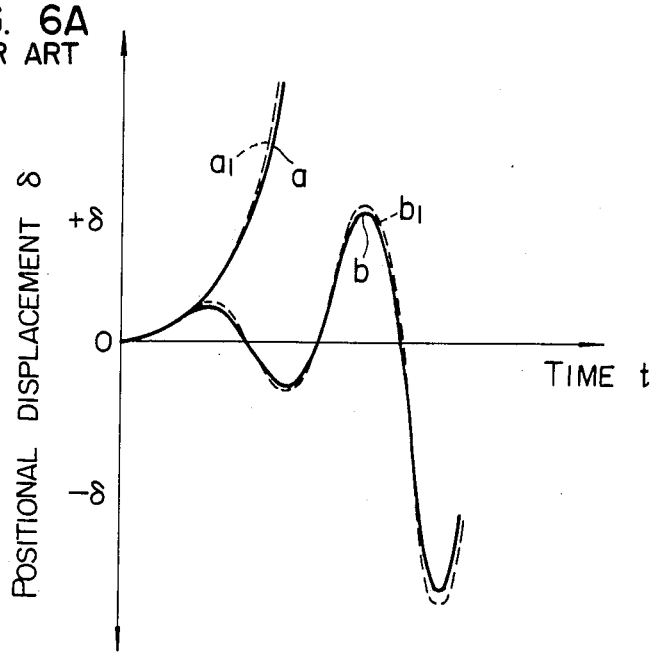
FIG. 6A PRIOR ART
FIG. 6A is a graph showing an actual example of the control characteristics of the conventional control system shown in FIG. 5.

An example of actual measurement of the control characteristics according to the above-mentioned prior art system is shown in FIG. 6A. The abscissa represents the time t that has elapsed, and the ordinate the positional displacement $\delta$ of the material being rolled at the reduction position. The character $+\delta$ shows the positional displacement toward the operating side from the center of the rolling mill, and the character $-\delta$ the positional displacement toward the driving side opposite to the operating side. To assure accuracy, the positional displacement $\delta$ is measured by use of punched marks as explained above. In FIG. 6A, the solid line a shows the characteristics associated with a small control gain and represents a simple divergence. The solid line b, on the other hand, shows the characteristics for a large control gain which diverges in the form of oscillation. Regardless of how the control gain is changed to a larger or smaller value, divergent control characteristics as shown in the solid line a or b are reached. Thus it is impossible to attain convergent stable control characteristics, so that in the case of each of the solid lines a and b, the material being rolled is curved, finally leading to an excessively reduced condition.

In order to obtain the characteristics of dashed lines $a_1$ and $b_1$, on the other hand, the actual values of $K_5$ to $K_9$ and $T_1$ and $T_2$ are determined from the rolling data and other information, and these actual values are used in the control block diagram of FIG. 5, thus determining the change in the positional displacement $\delta$ of the material with respect to the time elapsed, by a computer. In the drawing, the dashed line $a_1$ corresponds to the solid line a, and the dashed line $b_1$ to the solid line b. The result of calculation coincides well with the actual value.

With reference to the control block diagram of FIG. 5, explanation will be made about the control characteristics in the hypothetical case where the time constants $T_1$ and $T_2$ showing the transfer lag for the operating section $c_1$ and zero. In this case, the transfer function between $\epsilon x$ and $\delta(s)$ is given as follows:

$$\frac{K_6}{s^2 + K_6(K - K_5)} \tag{11}$$

By reverse transformation of the expression (11) into the time function, the positional displacement $\delta$ of the rolled material with time t is given by the equation (12) shown below.

$$\delta(t) = \frac{1}{K - K_5}\{1 - \cos\sqrt{K_6(K - K_5)\cdot t}\} \tag{12}$$

As apparent from this equation (12), the change in positional displacement $\delta$ with time in the case where $K \leqq K_5$ takes the simple divergent characteristics similar to the solid line a of FIG. 6, whereas in the case where $K > K_5$, the persistent oscillatory characteristics are obtained. As seen from above, even if $T_1 = T_2 = 0$ without any time lag in the control operation, it is impossible to attain the convergent stable control characteristics.

It will be understood from the foregoing description that according to the prior art systems of snake motion control, the basic requirements of continuous feedback control are not satisfied. Therefore, unless some novel device is introduced, the divergent control characteristics are unavoidable, resulting in the serious disadvantage that the control function cannot be performed.

SUMMARY OF THE INVENTION

Accordingly, it is an object of the present invention to provide a method and an apparatus for controlling rolling mills which can prevent the snake motion of the rolled material effectively thus eliminating the shortcomings of the above-mentioned prior art roll mill control systems.

According to an aspect of the present invention, a value corresponding to a snake motion of the material being rolled, which is detected on the rolling mill, is added to a value corresponding to a differentiated value of the snake motion corresponding value, and in response to the resulting sum signal the material being rolled is controlled, thus preventing the snake motion of the material from occurring.

DESCRIPTION OF THE PREFERRED EMBODIMENTS

Embodiments of the method and apparatus for controlling the rolling mill according to the present invention will be explained in detail below mainly with reference to FIGS. 6B to 17.

Figure 7:
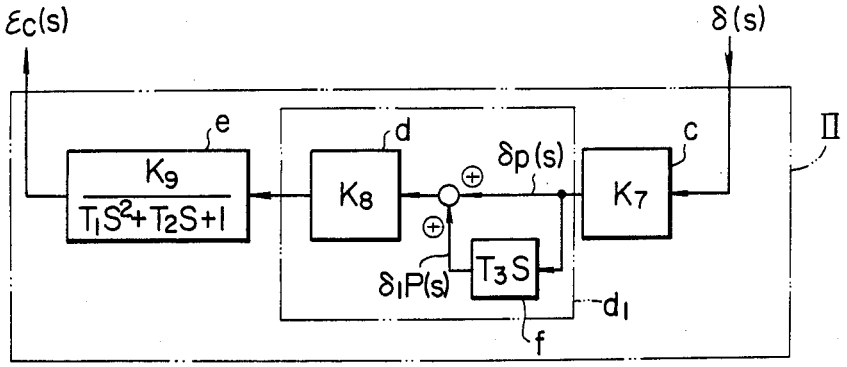
FIG. 7 is a control block diagram showing an embodient of the rolling mill control system according to the present invention.

FIG. 7 shows an example of block diagram of the control section according to the present invention corresponding to the conventional control section II in FIG. 5.

In FIG. 7, a block $d_1$ defined by a two-dotted-chain line shows a control arithmetic section according to the present invention, character f represents a differentiation transfer function of a detection signal $\delta p$, and character $T_3$ the differentiation time constant thereof. Character $\delta_{1p}$ represents a differentiation signal. This differentiation signal $\delta_{1p}$ is added to the detection signal $\delta_p$, and the resulting sum is applied to a control arithmetic section d which is the same as that in the conventional control system.

The characteristics expression for the snake motion control system in general according to the present invention in which the block diagram of the control section II in FIG. 5 is improved as shown in FIG. 7 are given as follows:

$$T_1 \cdot s^4 + T_2 \cdot s^3 + (1 - K_5 \cdot K_6 \cdot T_1)s^2 + K_6(K \cdot T_3 - K_5 \cdot T_2) \cdot s + K_6(K - K_5) > 0 \tag{13}$$

In order that all the roots of the characteristics inequality (13) have a negative real number for convergent stable control, the necessary and sufficient conditions in the form of inequalities (14) to (19) below must be satisfied.

$$T_1 > 0 \tag{14}$$

$$T_2 > 0 \tag{15}$$

$$1 - K_5 \cdot K_6 \cdot T_1 > 0 \tag{16}$$

$$K_6(K \cdot T_3 - K_5 \cdot T_2) > 0 \tag{17}$$

$$K_6(K - K_5) > 0 \tag{18}$$

$$(K \cdot T_3 - K_5 \cdot T_2)(T_2 - K \cdot K_6 \cdot T_1 \cdot T_3) - T_2^2(K - K_5) > 0 \tag{19}$$

Figure 6B:
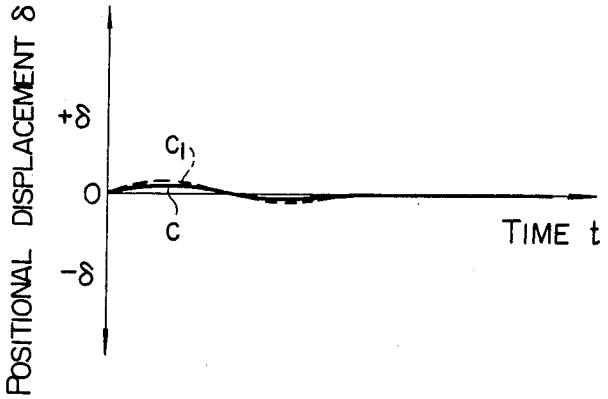
FIG. 6B is a graph showing an actual example of the control characteristics of an embodiment of the present invention shown in FIG. 7.

In the inequalities (14) to (19), $T_1$, $T_2$, $K_5$, $K_6$ and $K \cdot T_3$ are all positive real numbers, while K and $T_3$ are arbitrarily variable. Also, $T_1$ and $T_2$ are arbitrarily variable to some degree, although they can not be zero. Therefore, if the values of $K \cdot T_3$, $T_1$ and $T_2$ are determined to satisfy all the conditions of the inequalities (14) to (19), then convergent stable control is possible. The solid line c in FIG. 6B shows the actual result of control according to the present invention. As seen, the amplitude of oscillation is attenuated with time, thus attaining convergent stable control characteristics. The dashed line $c_1$ shows the result of calculation made concerning the solid line c with actual values substituted into the respective transfer functions.

Figure 8:
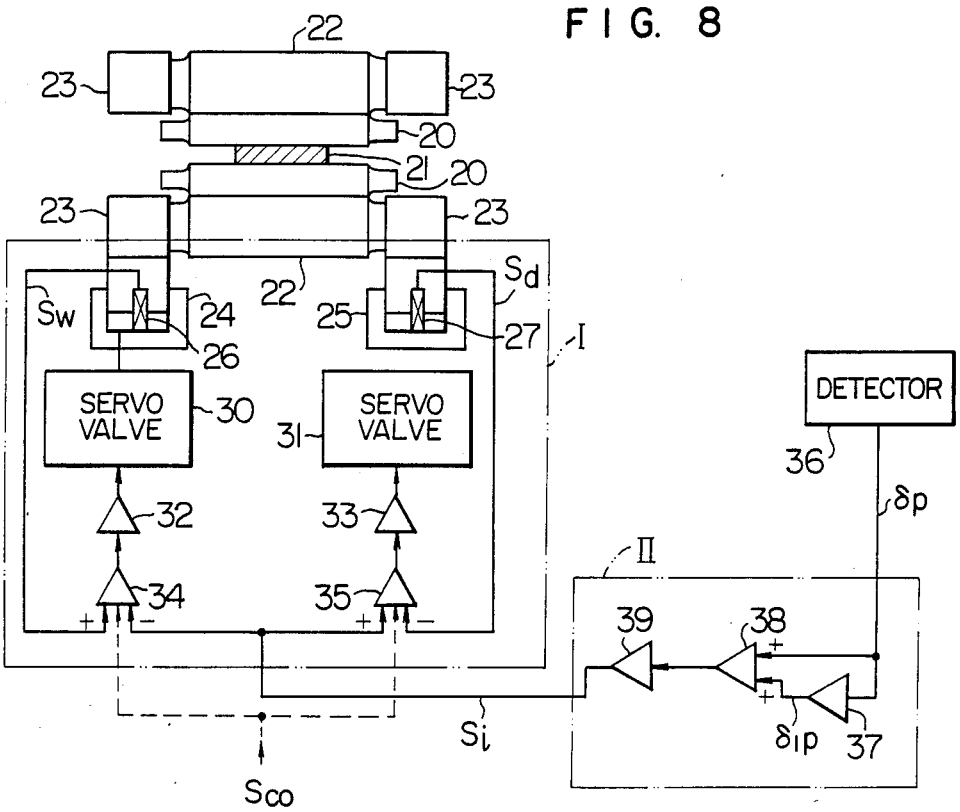
FIG. 8 is a schematic diagram for explaining an embodiment of the rolling mill control system according to the present invention in an actual case embodying the system of FIG. 7.

The diagrams of FIGS. 8 to 15 are provided for explaining both particularly and in detail the embodiment of FIG. 7 according to the present invention. FIG. 8 shows a control system according to an embodiment of the present invention, and FIGS. 9A and 9B block diagrams thereof.

In FIG. 8, a section I defined by a two-dotted-chain line shows a hydraulically operated reducton section corresponding to the parts 9 and 10 in FIGS. 3A, 3B and 3C. The gap between work rolls 20 for rolling a material 21 is controlled by adjusting the respective ram positions of hydraulic jacks 24 and 25 through a backup roll 22 and metal chocks 23. The respective ram positions of the hydraulic jacks 24 and 25 are detected and the position signals $S_w$ and $S_d$ are fed by position detectors 26 and 27, so that the deviations of the ram positions from the commanded values are calculated by arithmetic elements 34 and 35. The error signals from the arithmetic elements 34 and 35 are applied through variable amplifiers 32, 33, and electro-hydraulic servo valves 30, 31 to the hydraulic jacks 24 and 25 respectively to thereby automatically control the respective ram positions of the hydraulic jacks 24 and 25 so that the respective ram positions coincide with their commanded values.

A detector 36 includes the detector 13 or the position detector 12 of FIG. 3A and the load meters 16 and 17 of FIG. 3C, and corresponds to the detection section $a_1$ of FIG. 4B for producing a detection signal $\delta p$ representing a value corresponding to the amount of snake motion.

In FIG. 8, a block II defined by a two-dotted-chain line shows a control arithmetic section coresponding to the control arithmetic section II of FIGS. 3A and 3C. A differentiator 37 differentiates the detection signal $\delta_p$ produced from the detector 36 and produces a differentiation signal $\delta_{1p}$. An arithmetic element 38 adds this differentiation signal $\delta_{1p}$ to the detection signal $\delta_p$, and the resulting sum signal is applied to a variable amplifier 39. In this respect, the embodiment under consideration is different from the prior art systems. The variable amplifier 39 is impressed with the signal produced from the arithmetic element 38 and produces an appropriate control signal $S_i$. The amplification sensitivity of this variable amplifier 39 is variable so as to adjust the control gain of the snake motion control. The control signal $S_i$ and a plate thickness control signal $S_{co}$ shown by a dashed line are simultaneously applied to the arithmetic elements 34 and 35 of the reduction section in a manner so that the right and left gaps between the work rolls 20 change at the same rate and in an opposite direction, i.e., with the right side open when the left side is closed and vise versa. Like the variable amplifier 39, the amount of differentiation of the differentiator 37 is variable in order to produce an appropriate amount of differentiation signal.

Figure 9A:
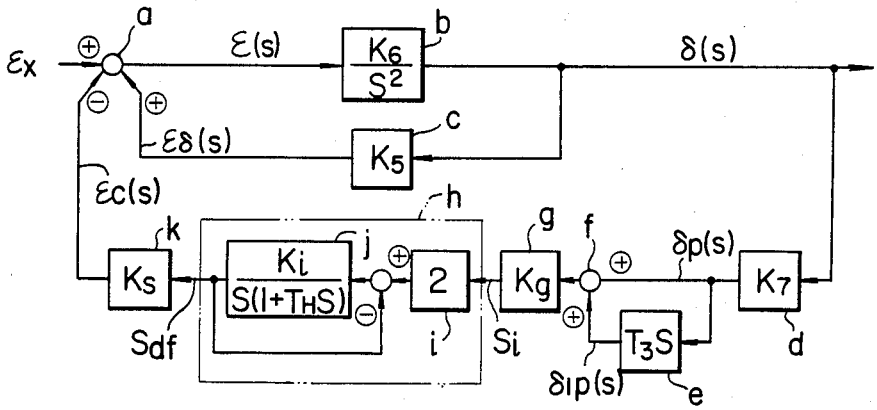
FIG. 9A is a control block diagram in which the control system of the embodiment shown in FIG. 8 is employed in the control loop of FIG. 1.

FIG. 9A is a block diagram in which the control functions of the system of FIG. 8 include the snake motion control function. Reference character $K_7$ of a transfer function d represents a detection gain of the detector 36 between the positional displacement signal $\delta$ of the material 21 and the detection signal $\delta_p$ in FIG. 8, character $T_3$ of a transfer function e represents a differentiation time constant of the differentiator 37 in FIG. 8, character f represents the function of the arithmetic element 38 in FIG. 8 for adding the detection signal $\delta_p$ and the differentiation signal $\delta_{1p}$, and character $K_g$ of a transfer function g represents the gain of the variable amplifier 39 in FIG. 8. A block h represents the reduction section I between the control signal $S_i$ in FIG. 8 and the difference $S_{df}$ between right and left roll gaps corresponding to values thereof under no-load condition at the reduction points of the work rolls 20 (right and left bearing points of the backup rolls 23). Character $K_i$ of a transfer function j designates a control gain for the position control of the reduction devices, which gain represents the magnitude of the ram change rate of the hydraulic jacks 24 and 25 with respect to the unit signal amount of the error signal produced by the arithemtic elements 34 and 35 and which gain is determined dependently on such factors as the respective gains of the variable amplifiers 32 and 33 in FIG. 8, the flow rate characteristics of the electro-hydraulic servo valves 30 and 31 and the sectional areas of the hydraulic jacks 24 and 25. Character $T_H$ of the same transfer function j designates a time constant representing the time delay in transmission of the pressurized oil, in the operation of the electro-hydraulic servo valves 30 and 31 or the like, and character $K_s$ of the transfer function k represents the change factor of the difference $\epsilon c$ between right and left reduction rates to the material in FIG. 8 with respect to the change in the above-mentioned difference $S_{df}$ between right and left roll gaps.

Figure 9B:
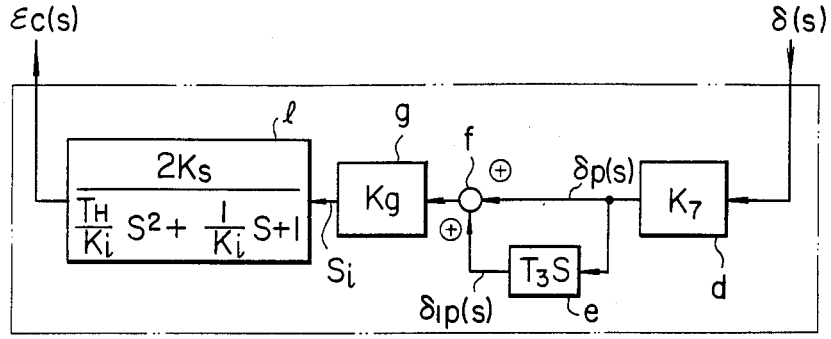
FIG. 9B is a control block diagram showing in summary the snake motion control loop of the control block diagram of FIG. 9A.

FIG. 9B shows a summary of block diagrams from $\delta(s)$ to $\epsilon c(s)$ in FIG. 9A. A transfer function l is a composite transfer function of the transfer functions h and k in FIG. 9A.

The block diagram of FIG. 9B which represents the control part of the snake motion control system shown in FIG. 8 may be converted into the same block diagram as FIG. 7 by substitution in such a manner that $$K_g = K_8,\ 2K_s = K_9,\ \frac{T_H}{K_i} = T_1 \text{ and } \frac{1}{K_i} = T_2.$$

From this, it is appreciated that the necessary and sufficient conditions for convergent and stable control of snake motion in FIG. 8 are given by the above-mentioned inequalities (14) to (19).

Figure 10:
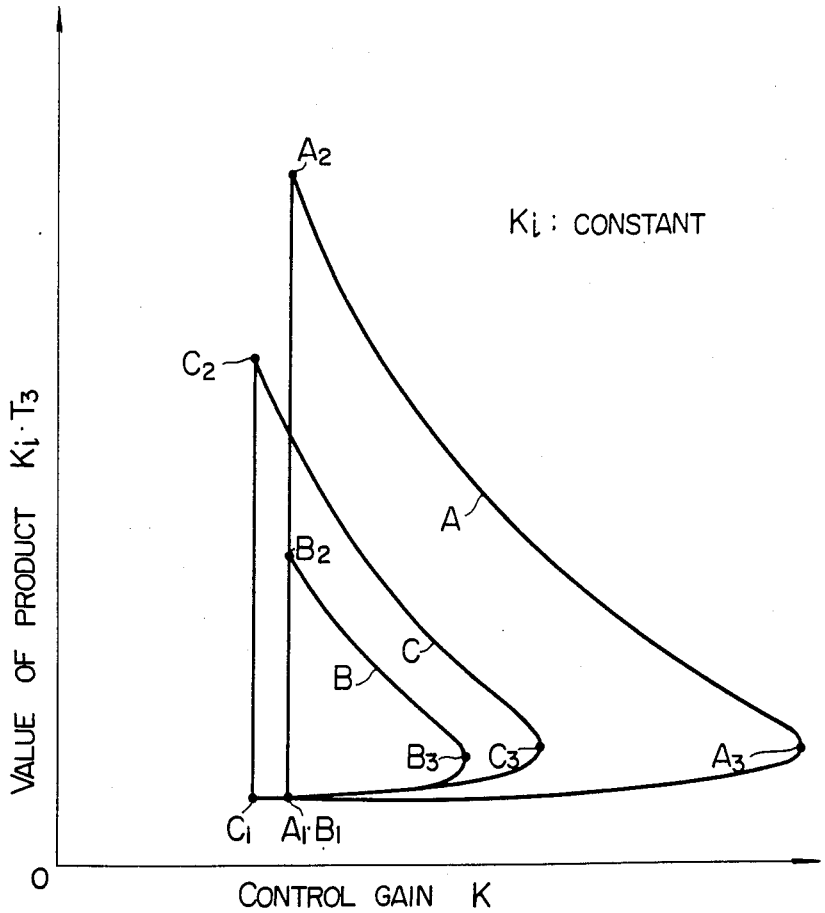
FIG. 10 is a graph showing the convergent stable region of the control in the embodiment of FIG. 8.

FIG. 10 shows the convergent stable region of the snake motion control system of FIG. 8 based on the inequalities (14) to (19). In the drawing, the abscissa represents the snake motion control gain $K(=K_7 \cdot K_8 \cdot K_9 = 2K_s \cdot K_7 \cdot K_g)$, and the ordinate represents the value $K_i \cdot T_3$ which is the product of the control gain $K_i$ of the position control of the reduction section and the differentiation time constant $T_3$, thus illustrating three convergent stable regions depending on the rolling conditions. As compared with the convergent stable region A shown by the curve connecting the points $A_1$, $A_2$, $A_3$ and $A_1$, the convergent stable region B shown by the curve connecting the points $B_1$, $B_2$, $B_3$ and $B_1$ is associated with the case in which only the rolling speed is changed. The convergent stable region C defined by the curve connecting the points $C_1$, $C_2$, $C_3$ and $C_1$, on the other hand, is the case in which only the plate width is different from that for the convergent stable region A. The parts surrounded by the curves represent convergent stable regions, within which convergent stable control is possible as shown by c and $c_1$ in FIG. 6B. In the areas other than these regions, by contrast, the control is divergent as shown by a, $a_1$ or b, $b_1$ in FIG. 6A.

In the conventional systems, the proper control is impossible since the control characteristics are always divergent. According to the present invention, by contrast, a convergent stable control may be achieved by selecting proper constants of the control loop as shown in FIG. 10.

Next, another embodiment shown in FIG. 11 will be explained below. In the case of the snake motion control system shown in FIG. 11, the difference $S_{df}$ between the right and left roll gaps $S_w$ and $S_d$ corresponding to values thereof under no-load condition and the difference $P_{df}$ between the right and left rolling loads $P_w$ and $P_d$ are detected, thus detecting the apparent difference $h_{df}$ between the right and left plate thicknesses at delivery side of the material. This difference $h_{df}$ between right and left plate thicknesses is controlled to become zero, thus preventing the snake motion from occurring.

Figure 11:
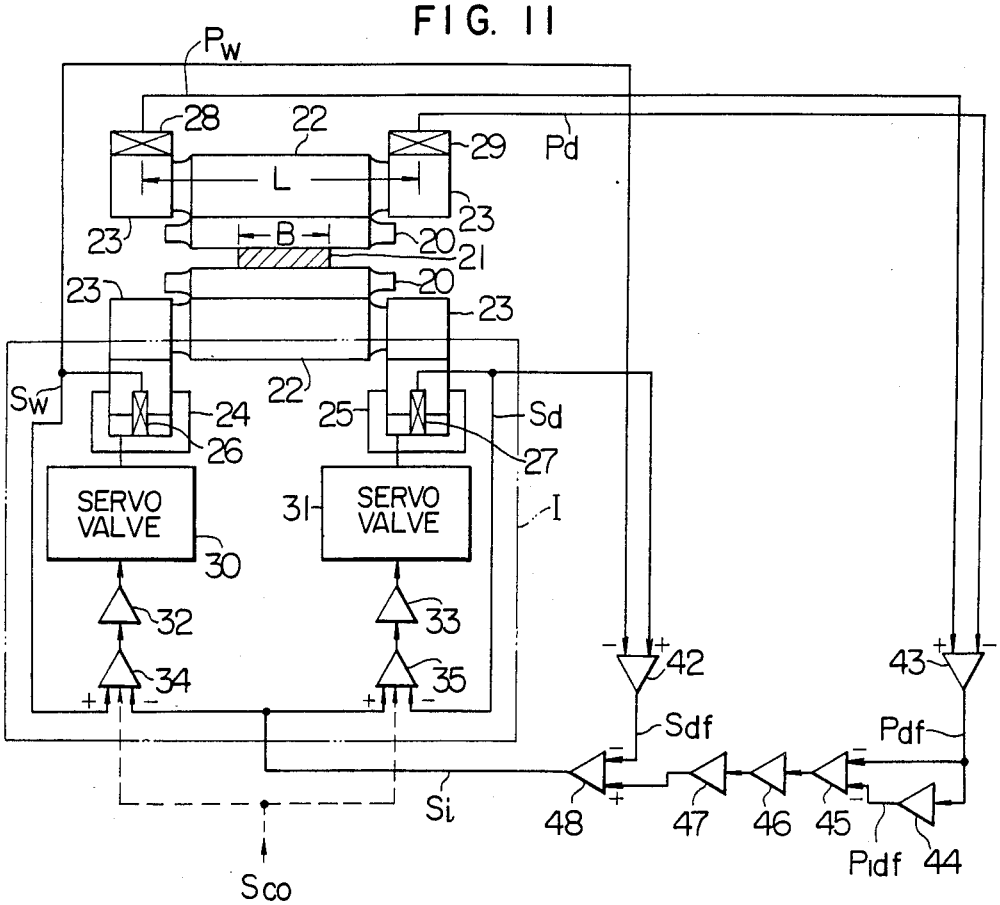
FIG. 11 is a schematic diagram for explaining another embodiment of the rolling mill control system according to the present invention in an actual case embodying the system of FIG. 7.

In FIG. 11, a block I defined by a two-dotted-chain line shows a reduction section similar to the block I of FIG. 8. The right and left rolling loads $P_w$ and $P_d$ are detected by rolling load meters 28 and 29 respectively, and the difference $P_{df}$ between right and left rolling loads $P_w$ and $P_d$ is calculated by an arithmetic element 43. This rolling load difference $P_{df}$ is applied through an arithmetic element 45 to a variable scale-factor element 46. The ratio of the parallel rigidity $K_l$ to the control factor $\alpha$ of the rolling mill is set in the variable scale-factor element 46. The parllel rigidity $K_l$ is the one along the plate width of the rolling mill, or more specifically, the ratio of the deflection difference of the rolling mill between right and left ends of the material 21 having the width B, i.e., a value $$h_{df} \times \frac{L}{B}$$

which is obtained by converting the difference $h_{df}$ between right and left end plate thicknesses of the material into the deflection difference between right and left reducing points (the length between the reducing points being L) of the rolling mill to the difference between the associated right and left rolling loads. This parallel rigidity $K_l$ is a value predetermined by actual measurement. Thus, the value $$\frac{1}{K_l} \cdot P_{df}$$

represents the magnitude of the difference between the right and left deflections of the rolling mill. The control factor $\alpha$, on the other hand, is for changing the apparent difference between right and left deflections of the rolling mill by changing the input of the difference $P_{df}$ between right and left rolling loads, and is used for adjusting the control gain of the snake motion control.

The deflection difference signal taking the value $$\frac{\alpha}{K_l} \cdot P_{df}$$

for the rolling mill, which is produced from the variable scale-factor element 46, is multiplied by 3/2 by a scale-factor element 47 and is applied to an arithmetic element 48 in which it is compared with the difference $S_{df}$ between right and left roll gaps corresponding to the values thereof under no-load condition which is produced from an arithmetic element 42, the difference therebetween being produced from the arithmetic element 48 in the form of a control signal $S_i$. The control signal $S_i$ is applied to arithmetic elements 34 and 35 of the reduction section in a manner so as to correct the difference between right and left deflections of the rolling mill.

The configuration illustrated above is such that the difference $S_{df}$ between right and left roll gaps corresponding to the values thereof under no-load condition undergoes a change by the amount equal to the apparent difference $$\frac{\alpha}{K_l} \cdot P_{df}$$

between the right and left deflections of the rolling mill, thus performing the reduction control to satisfy the under-shown equation (20).

$$S_{df} = -\frac{\alpha}{K_l} \cdot P_{df} \tag{20}$$

This means that as apparent from the under shown equation (21) derived from the equation (20), the sum of the apparatus displacement difference $$\frac{\alpha}{K_l} \cdot P_{df}$$

of the rolling mill caused by the difference $P_{df}$ between right and left rolling loads and the difference $S_{df}$ between right and left roll gaps corresponding to the values thereof under no-load condition, i.e., the apparent difference between right and left plate thicknesses of the material 21 is reduced to zero.

$$\frac{\alpha}{K_l} \cdot P_{df} + S_{df} = 0 \tag{21}$$

As seen from the foregoing description, the snake motion control system shown in FIG. 11 provides an example having a feature that the parallel rigidity is predetermined and both the difference $P_{df}$ between right and left rolling loads and the difference $S_{df}$ between right and left roll gaps corresponding to the values thereof under no-load condition are detected, so that the difference between right and left plate thicknesses of the material is reduced to zero, thus preventing the snake motion of the material rolled from occurring.

In FIG. 11, the rolling load difference signal $P_{df}$ produced from the arithmetic element 43 is differentiated by a differentiator 44, and the resulting differentiation signal $P_{1df}$ is added to the rolling load difference signal $P_{df}$ in the arithmetic element 45, so that this sum signal is fed back as a rolling load difference signal.

Figure 12:
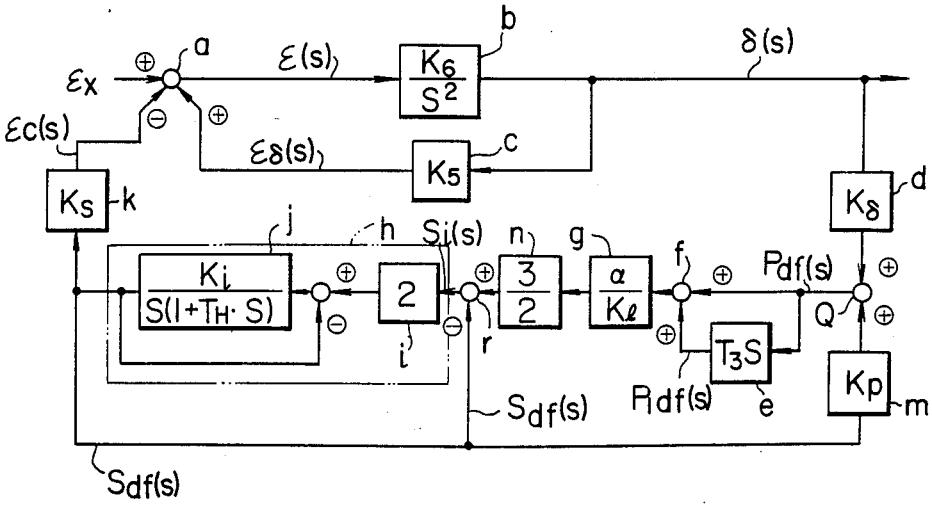
FIG. 12 is a control block diagram in which the control system according to the embodiment of FIG. 11 is employed in the control loop shown in FIG. 1.

FIG. 12 is a block diagram showing the control functions of the snake control system of FIG. 11 including the snake motion control loop. Character $K\delta$ of a transfer function d is the one between the positional displacement $\delta$ of the material and the difference between right and left rolling loads caused by this positional displacement $\delta$, character $K_p$ of a transfer function m is the one between the difference $S_{df}$ between right and left roll gaps and the difference between right and left rolling loads caused by the change in the difference between right and left roll gaps, character $T_3$ of a transfer function e shows a differentiation time constant of the differentiation circuit 44 in FIG. 11, $\frac{2}{3}$ and $\alpha/K_l$ of a transfer functions g and n are the ones for the variable scale-factor element 46 and scale-factor element 47 respectively, the addition point $\gamma$ is for adding the output signal of the scale-factor element 47 to the difference $S_{df}$ between right and left roll gaps produced from the arithmetic element 48 in FIG. 11, and the output $P_{df}(s)$ of the addition point Q is detected as the sum of the rolling load difference signal caused by the positional displacement of the material and the rolling load difference signal caused by the change in the difference $S_{df}(s)$ between right and left roll gaps, the output $P_{df}(s)$ thus representing the detected rolling load difference between the right and left rolling load meters 28 and 29 produced from the arithmetic element 43 in FIG. 11.

Figure 13:
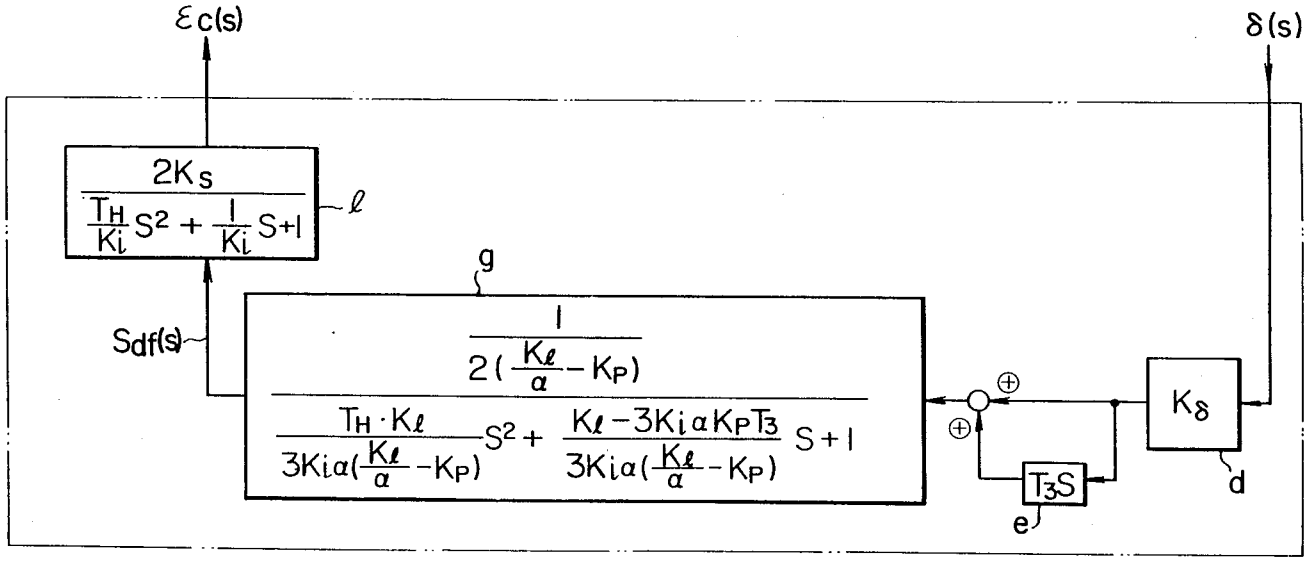
FIG. 13 is a control block diagram showing in summary the snake motion control loop of the control block diagram of FIG. 12.

FIG. 13 is a block diagram showing in summary fashion the respective blocks from $\delta(s)$ to $\epsilon c(s)$ in FIG. 12. The parts shown in FIG. 13 correspond to the block diagram of the control device section of FIG. 9B in the snake motion control system shown in FIG. 8.

The under-shown inequalities (22) to (26) show the necessary and sufficient conditions for stable convergent control in the example of the snake motion control system in FIG. 11 from the block diagram of FIG. 12. It is possible to attain stable convergence by properly determining the control factor $\alpha$, the differentiation time constant $T_3$ and the positional control gain $K_i$ of the reducer.

$$K_i \cdot T_3 \cdot K_p < \frac{K_l}{3\alpha} \tag{22}$$

$$3K_i\left(1 - \frac{\alpha \cdot K_p}{K_l}\right) > K_5 \cdot K_6 \cdot T_H \tag{23}$$

$$\frac{3\alpha}{K_l}(K_s \cdot K_\delta + K_5 \cdot K_p)K_i \cdot T_3 > K_5 \tag{24}$$

$$K_s \cdot K_\delta + K_5 \cdot K_p > \frac{K_l}{\alpha} \cdot K_5 \tag{25}$$

$$9K_i^2 + T_3^2 - \tag{26}$$

$$\left\{1 + \frac{K_l}{\alpha \cdot K_p} - \frac{K_6 \cdot T_H \cdot T_3}{K_p}(K_s \cdot K_\delta + K_5 \cdot K_p)\right\} \times$$

$$3K_i \cdot T_3 + \frac{K_l}{\alpha \cdot K_p}(1 - K_5 \cdot K_6 \cdot T_H \cdot T_3) < 0$$

Figure 14:
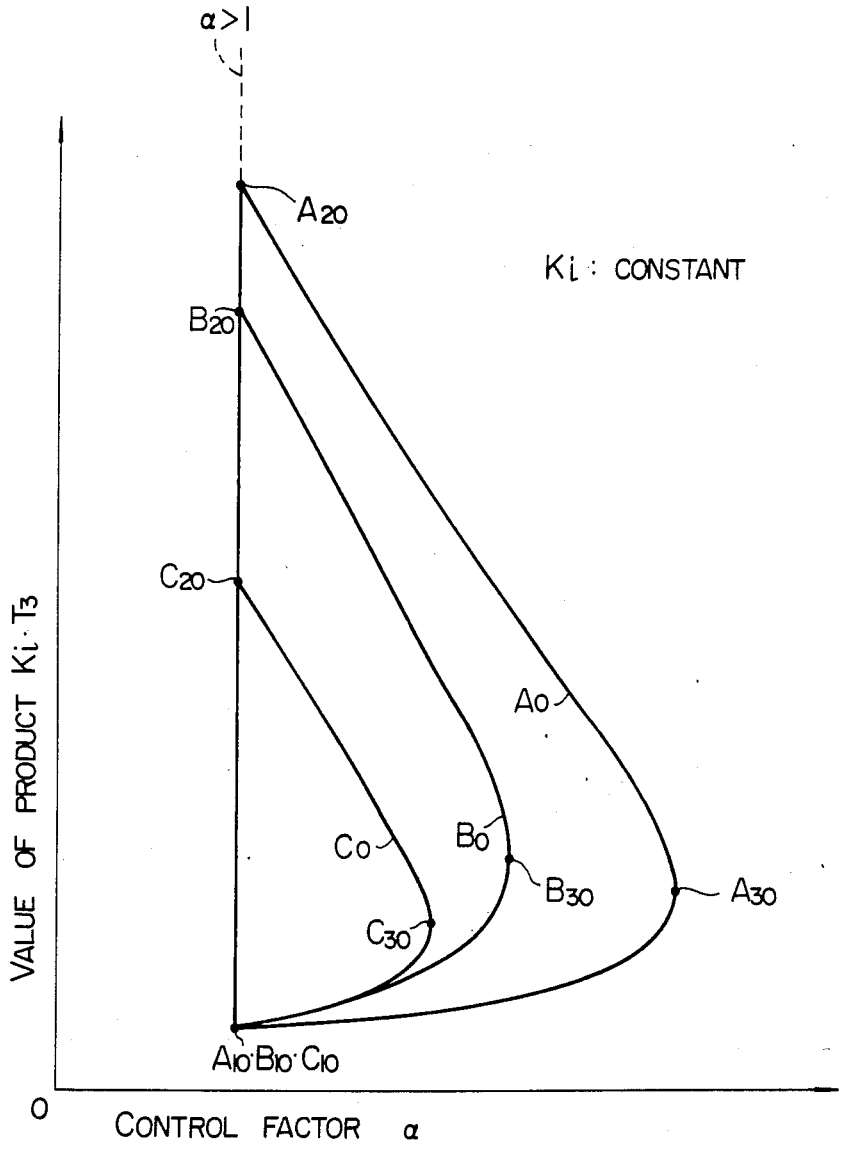
FIG. 14 is a graph showing the convergent stable region of the control in the embodiment of FIG. 12.

The diagram of FIG. 14 shows the convergent stable region for the snake motion control system shown in FIG. 11 attained on the basis of the inequalities (22) to (26). The abscissa represents the control factor $\alpha$, and the ordinate the product $K_i \cdot T_3$ of the positional control gain $K_i$ of the reducer and the differentiation time constant $T_3$. In this diagram, the convergent stable region is determined under the same rolling conditions as in the snake motion control system of FIG. 8 as explaind with reference to FIG. 10. In FIG. 14, the convergent stable region $A_0$ shown by the curve connecting the points $A_{10}$, $A_{20}$, $A_{30}$ and $A_{10}$, the convergent stable region $B_0$ shown by the curve connecting the points $B_{10}$, $B_{20}$, $B_{30}$ and $B_{10}$, and the convergent stable region $C_0$ shown by the curve connecting the points $C_{10}$, $C_{20}$, $C_{30}$ and $C_{10}$ respectively correspond to the convergent stable regions A, B and C in FIG. 10. The portions surrounded by the curves represent the convergent stable regions, in which convergent stable control is attained as shown by c and $c_1$ in FIG. 6B. In the areas outside of these regions, on the other hand, the control characteristics are divergent as shown by a, $a_1$ and b, $b_1$ in FIG. 6A. Unlike in the above-mentioned control system according to the present inventon, in the conventional system lacking the differentiation signal $P_{1df}$ of the differentiator 44 in FIG. 11, it is apparent by substituting 0 into $T_3$ in the inequalities (22) to (26) that the conditional inequalities (24) and (26) become inequalities (27) and (28). In view of the fact that $K_5$, $\alpha$, $K_l$ and $K_p$ are positive real numbers and therefore the conditions of under-shown inequalities (27) and (28) are never satisfied, the control is always divergent, thus making the control impossible.

$$K_5 < 0 \tag{27}$$

$$\frac{K_l}{\alpha \cdot K_p} < 0 \tag{28}$$

Figure 15A:
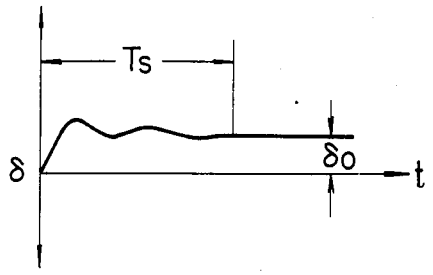
FIGS. 15A, 15B, 15C are graphs showing the change in transient characteristics of control within the convergent stable region shown in FIGS. 11 and 14.
Figure 15B:
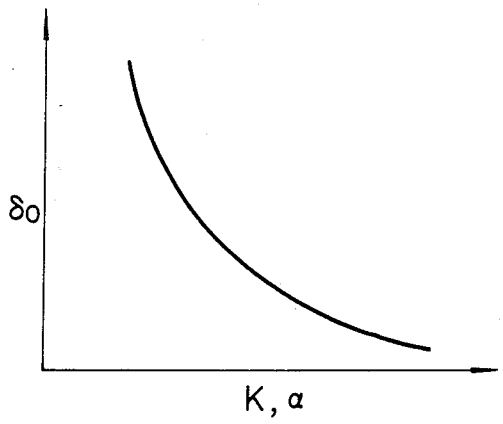
Figure 15C:
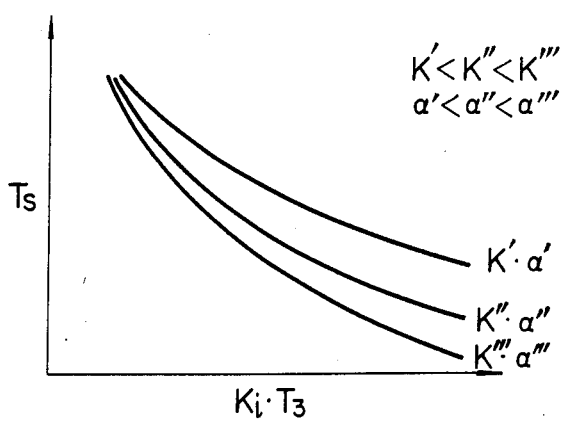

The loop for snake control includes transfer factors such as $K_5$, $K_6$, $K_3$, $K_\delta$ and $K_p$ in FIGS. 9 and 12 which depend on the rolling conditions such as the rolling speed, plate width, plate thickness, reduction ratio, plate crown, and hardness and material of the plate, rolling load and tension. Therefore, as an example is shown in FIGS. 10 and 14, the convergent stable regions for control are also dependent to a large measure on the change in the rolling conditions. Further, as shown in FIGS. 15A to 15C, even within the convergent stable regions, the control characteristics may change depending on the relative magnitudes of the control gain $K_i$, the control gain K, the control factor $\alpha$ and the differentiation time constant $T_3$. FIG. 15A shows a transient response waveform of the positional displacement $\delta$ of the material relative to the stepwise change in the right and left reduction rates $\epsilon x$ caused by an external factor. In this graph, $T_s$ shows the settling time required before transient vibrations are settled, and $\delta_o$ shows the amount of offset of the positional displacement of the rolled material. FIG. 15B shows the change in offset amount with the control gain K or control factor $\alpha$ within the convergent stable region. The larger the value K or $\alpha$, the smaller the offset amount $\delta_o$. Further, FIG. 15C shows the change in the settling time $T_s$ with the change of the control gain $K_i$, the differentiation time constant $T_3$, K and $\alpha$. The settling time $T_s$ becomes shorter with the increase in the value $K_i \cdot T_3$, K or $\alpha$. For the purpose of control, a small settling time or offset amount is desirable, and for this reason, the optimum setting of the above-mentioned constants are situated at or in proximity to points $A_3$, $B_3$, $C_3$ or $A_{30}$, $B_{30}$, $C_{30}$ within the convergent stable region shown in FIGS. 10 and 14 as obvious from FIGS. 15A to 15C.

It is evident from the foregoing description that in embodying the control system of the present invention, convergent stable control is necessary, and for optimum control, each of the above-mentioned constants is required to be properly selected and set in accordance with the rolling conditions.

In the process control, the control signal is differentiated to compensate for the control in the prior art, the purpose of which is to improve the control characteristics such as the control responsiveness or transient response characteristics. In principle, however, a control is possible without such a compensation by differentiation. The purpose of the differentiation for the snake motion control effected according to the present invention, by contrast, is to make possible the control which is impossible in the prior art and is not to improve the control characteristics such as the control responsiveness or transient characteristics. This is in view of the fact that the prior art system fails to satisfy the requirements for feedback control, unavoidably resulting in the divergent control characteristics. Therefore, the purpose of the differentiation in the present invention is essentially different from the purpose of the compensation by differentiation in the process control carried out in the prior art systems.

In the embodiments of the present invention shown in FIGS. 8 and 11, hydraulic means are used for controlling the difference $\epsilon_c$ between right and left reduction rates in the control of the material 21. This hydraulic means, however, may be replaced with equal effect by any other means including electrically-operated reduction or bender or other means capable of changing the difference between right and left reduction rates of the material.

Figure 16:
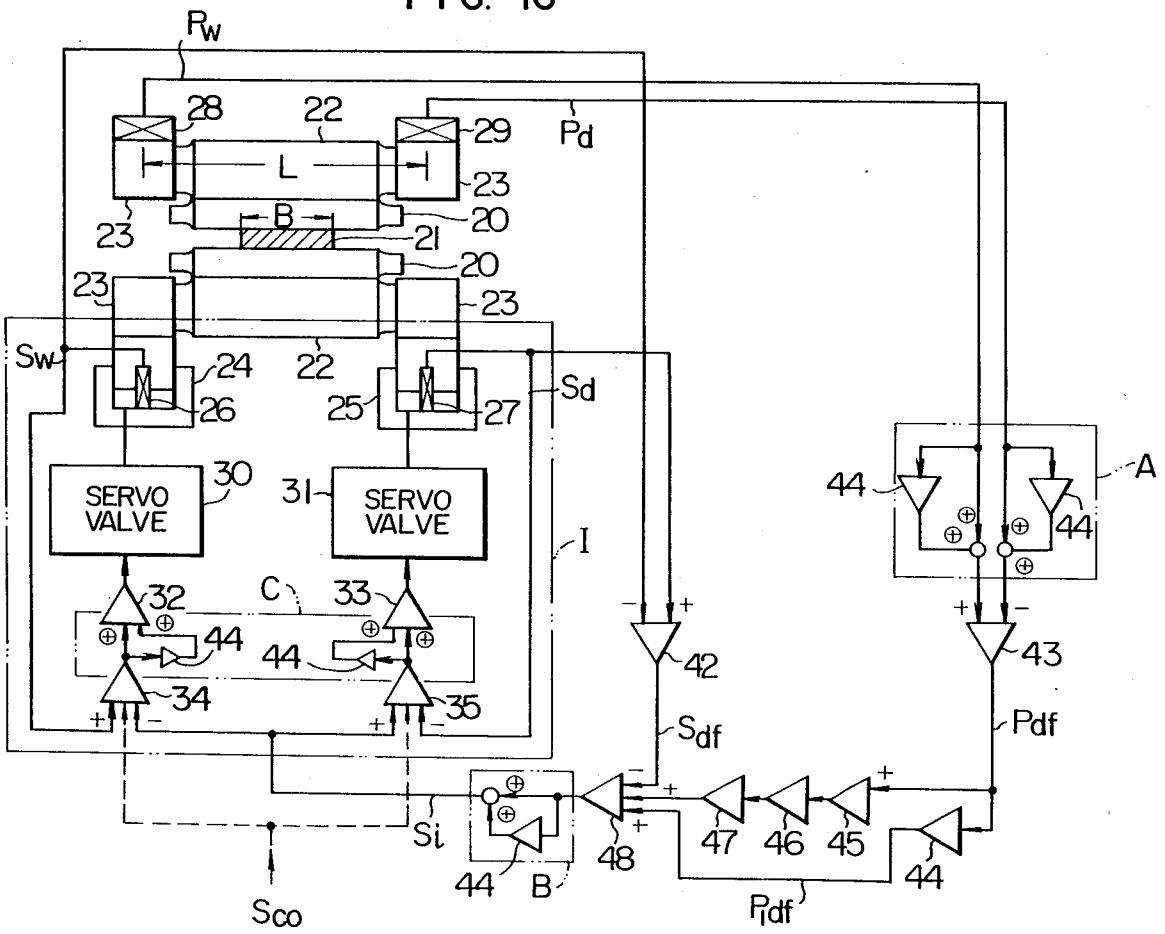
FIG. 16 is a schematic diagram for explaining another embodiment of the rolling mill control system according to the present invention.

FIG. 16 shows an example of application of the snake motion control system according to the present invention shown in FIG. 11. The signal to be differentiated and added is not limited to the rolling load difference signal $P_{df}$ shown as an embodiment in FIG. 11 but may take the form of any other signal on a route forming a closed loop for signal transmission. For instance, one of the means shown by two-dotted-chain lines A, B or C in FIG. 16 may be used. As an alternative, the differentiation signal $P_{ldf}$ of the differentiator 44 may be directly applied to the arithmetic element 48, or various other modifications may of course be made without departing from the spirit of the present invention.

The differentiated signal $\delta_p$ of the positional difference signal $\delta$ produced from the detector 36 or an equivalent detection signal $\delta_p$ to this positional difference signal $\delta$ in FIG. 8 and the differentiated signal $P_{ldf}$ of the rolling load difference signal $P_{df}$ produced from the arithmetic element 43 in FIG. 11 make up signals representing values corresponding to the positional displacement speed $V_\delta$ of the material 21 and the incident angle $\theta$ at the input side of the material respectively. In order to achieve the object of the present invention, therefore, the incident angle $\theta$ at the input side of the material 21 or the positional displacement speed of the material 21 may alternatively be detected and the resulting detection signal may be replaced by the differentiation signal $\delta_{lp}$ in FIG. 8 or the differentiation signal $P_{ldf}$ in FIG. 11 with equal effect.

Figure 17A:
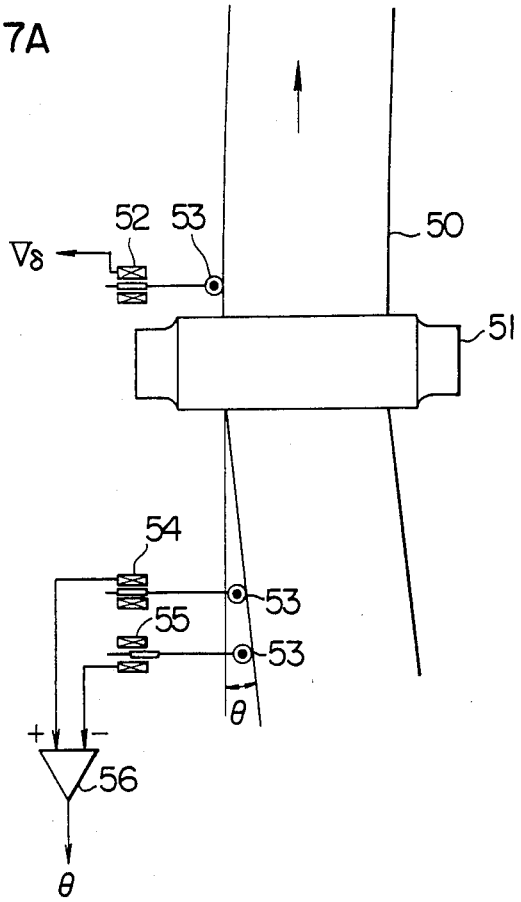
FIGS. 17A, 17B and 17C are diagrams showing other embodiments of the rolling mill control system according to the present invention.
Figure 17B:
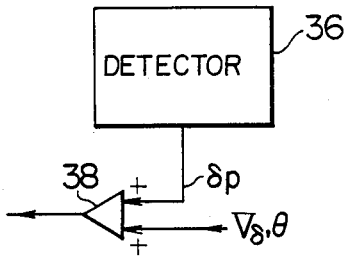
Figure 17C:
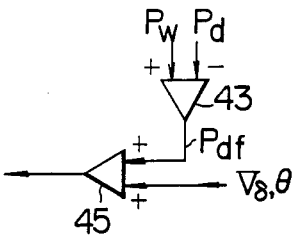

A modification of a part of the above-described embodiments of the present invention is shown in FIGS. 17A, 17B and 17C. FIG. 17A shows an example of a system for detecting the positional displacement speed and the incident angle at the input side of the material 21. FIGS. 17B and 17C show that the output of the embodiment shown in FIG. 17A is applied to a part of the embodiments of FIGS. 8 and 11 respectively. In FIG. 17A, the positional displacement speed $V_\delta$ along the width or in the transversal direction of a material 50 is detected by a direct-acting speed detector 52 via a free roller 53 which is in contact with the material 50. Also, the incident angle $\theta$ at the input side of the material 50 is detected and produced by an arithmetic element 56 on the basis of the relative change in the detection signals of displacement detectors 54 and 55 such as differential transformers disposed at predetermined intervals along the length of the material 50. The positional speed detection signal $V_\delta$ or the input side incident angle detection signal $\theta$, instead of the differentiation signal $\delta_{lp}$ in FIG. 8, is applied to the arithmetic element 38 shown in FIG. 17B. Similarly, in the embodiment of FIG. 11, an equivalent signal replacing the differentiation signal $P_{ldf}$ is applied to the arithmetic element 45 shown in FIG. 17C. The detection signal is not limited to a signal representing the positional displacement speed or input side incident angle of the material but may take the form of a detection signal equivalent to a signal representing the differentiation of the positional displacement of the material. Further, various modifications of the present invention are of course possible without departing from the spirit thereof.

It will be understood from the foregoing description that according to the control system for the rolling mill of the present invention, the snake motion of the material being rolled is effectively prevented.

What is claimed is:

1. In a method for controlling a rolling mill including a step of obtaining a first value corresponding to an amount of a snake motion of a material being rolled so as to control the snake motion of the material; the improvement further comprising counteracting instability which occurs regardless of system gain in trying to control said snake motion by obtaining a second value corresponding to a differentiated value of said first value, obtaining a first sum of said first and second values, multiplying the first sum by a variable control factor given by $\alpha$/Kl where $\alpha$ is a control factor larger than "1" and Kl is the parallel rigidity of the rolling mill, and applying a control operation to the material being rolled to control the snake motion on the basis of the result of said multiplication of said first sum by said variable control factor to prevent a divergent control characteristic for the snake motion control which develops due to instability regardless of the system gain if only the first value is used for controlling the snake motion.

2. A method according to claim 1, wherein said first value obtaining step includes a step for detecting a difference in rolling load between values at an operating and a driving side of roll means of said rolling mill, said rolling load difference being used as said first value.

3. A method according to claim 1, wherein said first value obtaining step includes steps of detecting a difference in rolling load between values at an operating and a driving side of roll means of said rolling mill, detecting a difference in roll gap between values at said operating and driving sides of said roll means corresponding to values thereof under no-load condition, and obtaining a second sum of said difference in rolling load and said difference in roll gap, said second sum being used as said first value.

4. A method according to claims 1, 2, or 3, wherein said second value and a control gain for said control operation are changed according to given rolling conditions.

5. A method according to claim 1, 2 or 3, wherein said second value is obtained by directly differentiating said first value.

6. A method according to claim 1, 2, or 3, wherein said second value is obtained by detecting the snake motion independently of said first value.

7. In an apparatus for controlling a rolling mill including first means for obtaining a first value corresponding to an amount of a snake motion of a material being rolled, to thereby control the snake motion on the basis of the output of said first means; the improvement further comprising second means for counteracting instability which occurs regardless of system gain in trying to control said snake motion by obtaining a second value corresponding to a differentiated value of said first value, third means responsive to said first and second means for obtaining a sum of said first and second values, means for multiplying said sum by a variable control factor given by $\alpha$/Kl where $\alpha$ is a control factor larger than "1" and Kl is the parallel rigidity of the rolling mill, and fourth means for applying a control operation to the material being rolled to control the snake motion on the basis of an output of said multiplying means to prevent a divergent control characteristic for the snake motion control which develops due to instability regardless of the system gain if only the first value is used for controlling the snake motion.

8. An apparatus according to claim 7, wherein said first means includes means provided on said rolling mill for detecting a position of the material being rolled.

9. An apparatus according to claim 7, wherein said first means includes means provided on the rolling mill for monitoring conditions of the material being rolled.

10. An apparatus according to claim 7, wherein said first means includes first and second rolling load detectors respectively provided on an operating side and a driving side of said rolling mill.

11. An apparatus according to claims 7, 8, 9 or 10, wherein said second means include means responsive to said first means for differentiating said first value.

12. An apparatus according to claim 7, 8, 9 or 10, wherein said second means includes at least one of means for detecting a speed of displacement of the material being rolled and means for detecting an incident angle of the material at an input side thereof.

13. A system according to claim 10, wherein said first means includes arithmetic means responsive to said first and second rolling load detectors for obtaining a difference in rolling load between values at said operating and driving sides of the roll means.

14. An apparatus according to claim 7, 10 or 13, further comprising, a first and a second detector provided on an operating a driving side of said rolling mill respectively for detecting respective roll gaps thereat corresponding to values thereof under no-load condition, a first arithmetic element responsive to said first and second roll gap detectors for obtaining a difference in roll gap corresponding to a value thereof under no-load condition, and a second arithmetic element for obtaining a difference between the respective outputs of said multiplying means and said first arithmetic element, said control operation being effected on the basis of the output of said second arithmetic element.

15. A rolling mill control apparatus comprising:

a first roll gap detector provided at an operating side of said rolling mill for detecting a roll gap corresponding to a value thereof under no-load condition;

a first rolling load detector provided at said operating side;

a second roll gap detector provided at a driving side of said rolling mill, for detecting a roll gap corresponding to a value thereof under no-load condition;

a second rolling load detector provided at said driving side;

a first operational amplifier for comparing the respective outputs of said first and second roll gap detectors with each other;

a second operational amplifier for comparing the respective outputs of said first and second rolling load detectors with each other;

means for multiplying the output of the second operational amplifier by a variable control factor given by $\alpha$/Kl where $\alpha$ is a control factor larger than "1" and Kl is the parallel rigidity of the rolling mill;

a third operational amplifier for comparing the output of said first operational amplifier with the output of said multiplying means; and control means for controlling respective reduction means at said operating and driving sides in response to the output of said third operational amplifier, wherein said system further comprises means for differentiating an amount of a first control signal which corrresponds to a snake motion of a material being rolled at one predetermined point in a control loop including said first and second rolling load detectors and said control means and means for counteracting instability which occurs regardless of system gain in trying to control said snake motion by adding the result of said differentiation to said amount of said first control signal to produce a combined control signal as a controlling output from said control means to control the snake motion on the basis of the combined control signal to prevent a divergent control characteristic for the snake motion control which develops due to instability regardless of the system gain if only the first control signal is used for controlling the snake motion.

16. An apparatus according to claim 15, wherein said differentiation-adding means differentiates each of the outputs of said first and second rolling load detectors and adds the values obtained by the differentiation to the outputs of said first and second rolling load detectors respectively, the respective resulting sums being applied to said second operational amplifier.

17. An apparatus according to claim 15, wherein said differentiation-adding means differentiates the output of said second operational amplifier and adds the value obtained by the differentiation to the output of said second operational amplifier, the resulting sum being applied to said third operational amplifier.

18. An apparatus according to claim 15, wherein said differentiation-adding means differentiates the output of said third operational amplifier and adds the value obtained by the differentiation to the output of said third operational amplifier, the resulting sum being applied to said control means so that said control means controls said respective reduction means in response to said sum.

* * * * *